US005674101A

United States Patent [19]

Saloor

[11] Patent Number: 5,674,101

[45] Date of Patent: Oct. 7, 1997

[54] AERIAL AMUSEMENT DEVICE

[76] Inventor: Shahriar Harry Saloor, Box 70, 84 Marylebone High Street, London, WIM 3DE, England

[21] Appl. No.: 464,864

[22] Filed: Nov. 20, 1995

[30] Foreign Application Priority Data

Jul. 23, 1993 [GB] United Kingdom ..... 9315285
Apr. 8, 1994 [GB] United Kingdom ..... 9407023

[51] Int. Cl.[6] ..... A63H 27/00

[52] U.S. Cl. ..... 446/46; 473/613

[58] Field of Search ..... 446/46–48; 273/424–427; 473/613–614

[56] References Cited

U.S. PATENT DOCUMENTS

| | | |
|---|---|---|
| 3,231,925 | 2/1966 | Conder . |
| 3,759,518 | 9/1973 | Mroz . |
| 4,071,237 | 1/1978 | Hoogasian . |
| 4,131,276 | 12/1978 | Judkins . |
| 4,200,288 | 4/1980 | Di Donato . |
| 4,262,911 | 4/1981 | Opresik et al. . |
| 4,294,447 | 10/1981 | Clark . |
| 4,321,888 | 3/1982 | Topliffe . |
| 4,580,990 | 4/1986 | Avery . |
| 4,756,529 | 7/1988 | Stillinger . |
| 4,962,926 | 10/1990 | Chen . |
| 4,973,284 | 11/1990 | Sassak . |
| 5,045,011 | 9/1991 | Lovik . |

FOREIGN PATENT DOCUMENTS

| | | |
|---|---|---|
| 861671 | 11/1959 | United Kingdom . |
| WO 9002780 | 5/1990 | WIPO . |

*Primary Examiner*—Robert A. Hafer
*Assistant Examiner*—D. Neal Muir
*Attorney, Agent, or Firm*—Watson Cole; Stevens Davis, P.L.L.C.

[57] ABSTRACT

A projectile device comprises a spherical core (1) with a flaccid circular wing (2) extending radially from its equator (4). Grooves (3) formed in the surface of wing (2) and core (1) provide increased friction. The device can be skimmed through the air or thrown like a ball and the wing (2) provides an increased surface area for easy catching.

17 Claims, 2 Drawing Sheets

AERIAL AMUSEMENT DEVICE

This invention relates to a toy for throwing and catching. In particular, the invention relates to a winged ball-like object which may be easily caught when thrown.

Certain sports, such as cricket, rugby, rounders and baseball, require the ability of a player to catch a ball. As well as providing amusement and entertainment, the acquisition of throwing and catching skills can help to develop co-ordination and motor control, especially in young children and those with disabilities. One of the problems with teaching someone how to catch a conventional ball, such as a cricket ball, is the speed with which it travels through the air. In the case of a cricket ball, this problem is compounded by the relatively small size of the ball, which can make it difficult to visualise in flight. Moreover, a cricket ball does not absorb much energy on impact, which can make it difficult and sometimes painful to catch.

A number of devices designed to provide amusement whilst improving catching skills have been described in the literature. U.S. Pat. No. 4,756,529 discloses an amusement device in the form of a bulky sphere, which has a core region surrounded by a dense array of randomly orientated elongate elastomeric filaments. In use, the filaments tend to thread their way between adjacent fingers of a catcher's hand which facilitates catching. U.S. Pat. No. 4,262,911 discloses a flying toy in the shape of a U.F.O., which has a hollow spherical body and a thin, relatively rigid wing attached to the body by spring means to provide additional thrust when the toy is flung. The wing is attached to an upper region of the body to provide good flying balance and the body has spiral fins to provide lift. U.S. Pat. No. 2,490,031 discloses a device for striking into the air with a paddle, which comprises a plurality of flexible fibres attached by a ring to a central member and secured in a plane by radial fastening means spaced from the member to form a flexible airfoil. U.S. Pat. No. 2,835,073 discloses a rotor-type flying device, which comprises a hollow spheroidal body, a fixed, annular wing section located centrally around the body and air intake means for imparting propulsion when the device is given a rotational impulse. U.S. Pat. No. 4,131,276 discloses a play ball, which comprises a bundle of resilient cellular foam strips of two different lengths, gathered together in the middle of the bundle by a band to form a spherical object.

However, previously known devices which purport to improve catching skills, including those described above, all suffer from certain disadvantages. Many of these devices require the assembly of a number of separate components into the finished article, making them more susceptible to damage and necessitating multiple step manufacturing processes. Several devices comprise rigid components attached to a central body, making them difficult and sometimes painful to catch. Some devices are easy to catch but possess poor aerodynamic properties making them difficult to throw in a straight line. A number of devices provide useful catching practice but do not resemble or behave like a conventional ball thus giving the user little experience of catching a real ball. It is an object of the present invention, therefore, to overcome some of the aforementioned disadvantages by providing a projectile device which presents an increased surface area to a catcher, yet retains many of the characteristics of a conventional ball.

Accordingly, in a first aspect of the present invention there is provided a projectile device comprising a convex core provided with outwardly extending and flaccid wing means, wherein said wing means is arranged for providing support to the device in flight. In the context of the invention, the term "flaccid" should be understood to mean "floppy", "pendulous", "drooping", or "hanging".

The projectile device according to the invention is preferably a toy for throwing and catching. The wing means presents an increased surface area to the catcher when the device is in flight but, being flaccid, the wing means can wrap or fold itself around the core on catching. This has the advantage of giving a catcher the sensation of catching the core on its own. The device according to the invention may also be skimmed through the air, like a "flying saucer", by grasping the wing means and throwing the device with an arcuate motion. When the device is skimmed in this way, it can be made to move more slowly through the air, giving a catcher more time to visualise the device before attempting to catch it. Thus, the inventive device can provide two separate forms of motion for a thrower or catcher to practice their skills.

In a preferred embodiment of the invention, the wing means comprises a single wing member disposed annularly about the core. Preferably, the wing member extends from an equatorial region of the core. In an especially preferred embodiment, the core is symmetrically disposed about the wing member. This gives the device good stability in flight as well as an aesthetically pleasing appearance. Moreover, if the core is symmetrically disposed with respect to the wing member, it does not matter which part of the core is uppermost when the device is skimmed through the air. In a further embodiment, the-core and the wing member are integrally formed from a resiliently flexible or elastic material. Preferably, this material is a rubber or a sponge rubber material, or a polyurethane foam or any suitable synthetic or naturally occurring polymeric material. Most preferably, the material is a silicone rubber material. The device may be coated with a thin layer of a second material to provide good handling properties or physical characteristics. Advantageously, a device in which the core and the wing means are integrally formed from an elastic or resiliently flexible polymeric material may be integrally moulded in a single moulding step.

The core may be any regular or irregular shape having a convex surface, is preferably ball-like, and can resemble a ball used for playing a sport, such as a cricket ball, football, base ball, rugby ball, golf ball etc., although it need not be full sized. In a preferred embodiment, the core has a substantially uniform diameter. Most preferably, the core is substantially spherical. The wing member can be any shape, such as circular or oval, but, preferably, it is distributed about the core in a balanced fashion. Preferably the wing member has a substantially uniform diameter. The ratio of the diameter of the wing member to the diameter of the core is preferably at least 1.25:1.

Preferably, this ratio is between 1.25:1 and 5:1. Most preferably, this ratio is about 3:1. Thus, the wing member presents a catcher with a large surface area to catch. The wing member should be relatively thin in order to make it flaccid but should be sufficiently thick to provide good durability when the device is in use. Preferably, the wing member is of substantially uniform thickness. Alternatively, the thickness of the wing member may increase with radial distance from the core in order to make the wing member more readily flaccid. The ratio of the thickness of the wing member to the diameter of the core is preferably between 1/70:1 and 1/20:1. Most preferably, the ratio of the thickness of the wing member to the diameter of the core is between 1/70:1 and 1/30:1.

In a further embodiment of the invention, the core or the wing member has a plurality of grooves or ridges defined in its surface to provide extra surface friction on catching. The grooves or ridges may be of any size, shape or orientation, suitable for increasing surface friction. In another embodiment, the wing member is pleated to provide an alternative form of grip. In yet another embodiment, the core has a hollow or partially hollow centre to provide a reduction in weight, so that the device is lighter and easier for a child to catch. The hollow or partially hollow centre of the core may contain a fluid substance, such as water, to provide further interest for a child. The device according to the present invention may be decorated so as to give it an appealing appearance to a child, for example, by being formed of coloured materials or being decorated with a pattern or a face. The device may also comprise a further component, such as an elasticated cord for suspending the device or providing means for throwing the same.

Specific embodiments of the invention will now be described by way of illustration only and with reference to the following drawings.

Figure 1:
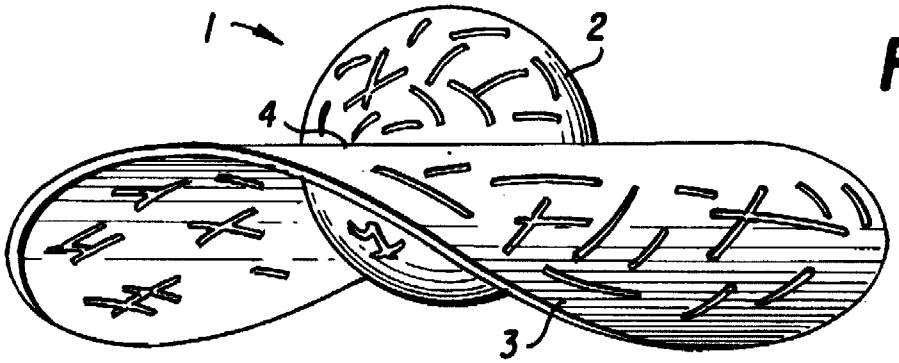
FIG. 1 shows a perspective view of a toy according to the invention in the form of a winged ball.
Figure 2:
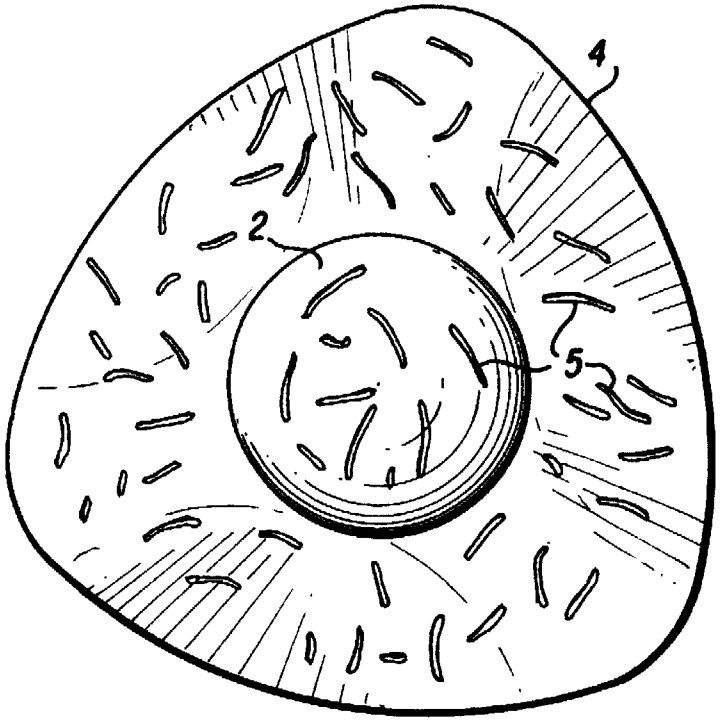
FIG. 2 shows a plan view of the toy shown in FIG. 1.
Figure 4:
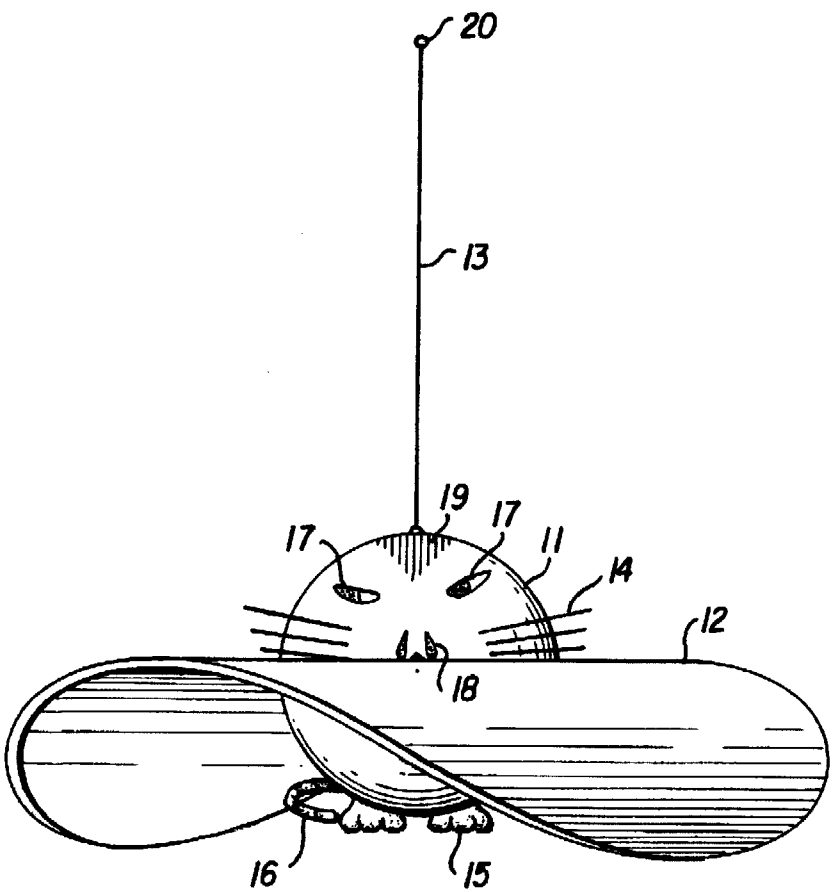
FIG. 4 shows a perspective view of a third toy according to the invention having an attached cord and cartoon-like features.
Figure 3:
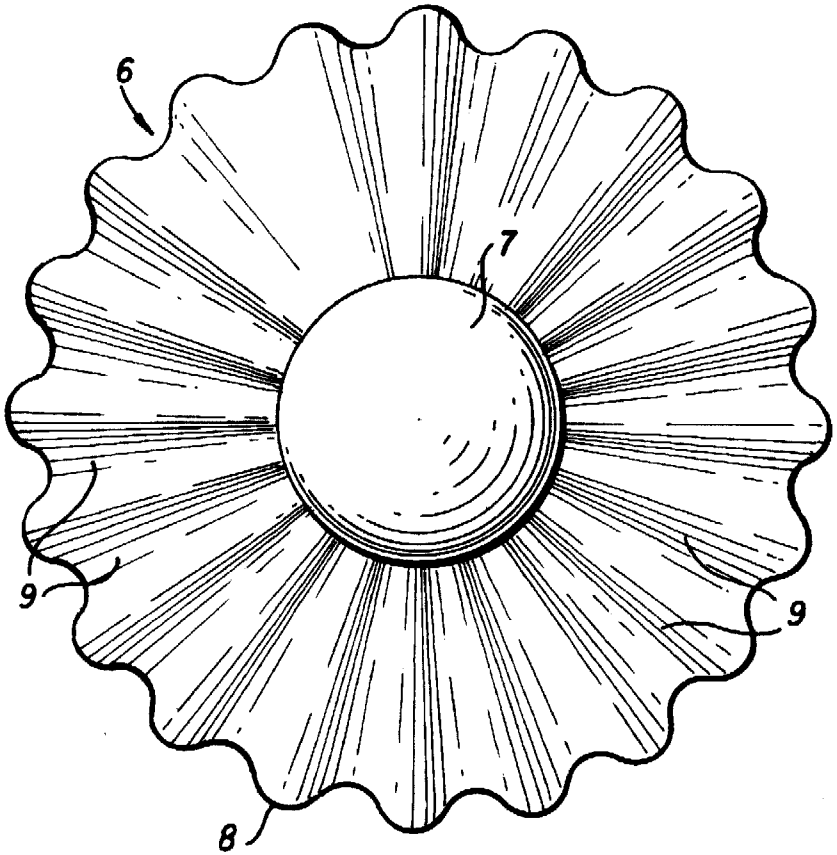
FIG. 3 shows a plan view of a second toy according to the invention and having a pleated wing.

A toy 1 is illustrated in FIG. 1 and comprises a spherical core 2 with a thin, flaccid annular wing member 3 extending radially outwardly from the equitorial region 4 of the core 2. Grooves 5 are formed in the surface of both the wing member 3 and the core 2 (see FIG. 2), although, in alternative embodiments, the grooves 5 can be omitted. FIG. 3 shows a second similar toy 6, comprising a spherical core 7 and a pleated annular wing member 8. The third toy 10, depicted in FIG. 4, also comprises a spherical core 11 with a flaccid annular wing member 12. However, the third toy 10, further comprises a cord 13, with a knot 20 at one end, attached to the core 11. Whiskers 14, feet 15 and a tail 16 are also attached to the core 2 and a face comprising eyes 17, a nose 18, and hair 19 is depicted on the core 2.

I claim:

1. A projectile device adapted for throwing and catching, comprising a central convex solid substantially spherical core providing some mass for flight and provided with outwardly extending and flaccid wing means, wherein said wing means is a single wing member disposed annularly about said core, said wing means being an equatorial flange of continuous flexible plastic material which extends without interruption throughout the equatorial region, said flange of flexible material having sufficient rigidity to provide stability during spinning flight and is arranged for providing support to the device in flight and adapted to assist the device for flight through the air.

2. The projectile device as claimed in claim 1, wherein said flaccid wing means can fold around the core.

3. A projectile device as claimed in claim 1, wherein said flaccid wing means is arranged to facilitate catching of the device.

4. A projectile device as claimed claim 1, wherein the core and said flaccid wing means are integrally formed.

5. A projectile device as claimed in claim 1, wherein said single wing member extends from an equatorial region of the core.

6. A projectile device as claimed in claim 1, wherein the core is symmetrically disposed about said single wing member.

7. A projectile device as claimed in claim 1, wherein the core is substantially spherical.

8. A projectile device as claimed in claim 7, wherein said flaccid wing means has a substantially uniform diameter.

9. A projectile device as claimed in claim 8, wherein the ratio of the diameter of said flaccid wing means to the diameter of the core is at least 1.25:1.

10. A projectile device as claimed in claim 9, wherein the ratio of the diameter of said flaccid wing means to the diameter of the core is between 1.25:1 and 5:1.

11. A projectile device as claimed in claim 10, wherein the ratio of the diameter of said flaccid wing means to the diameter of the core is about 3:1.

12. A projectile device as claimed in claim 7, wherein said flaccid wing means is of substantially uniform thickness.

13. A projectile device as claimed in claim 7, wherein said flaccid wing means has a thickness that increases with radial distance from the core.

14. A projectile device as claimed in claim 12, therein the ratio of the thickness of said flaccid wing means to the diameter of the core is between 1/70:1 and 1/20:1.

15. A projectile device as claimed in claim 14, wherein the ratio of the thickness of said flaccid wing means to the diameter of the core is between 1/70:1 and 1/30:1.

16. A projectile device as claimed in claim 1, wherein said single wing member is pleated.

17. A projectile device as claimed in claim 1, wherein the core or said single wing member has a plurality of grooves defined in its surface.

* * * * *